US005875383A

United States Patent [19]

Stemmle

[11] Patent Number: 5,875,383

[45] Date of Patent: Feb. 23, 1999

[54] DUAL MODE INTERCHANGEABLE MODULES CUT SHEET OR WEB PRINTING SYSTEM WITH A SINGLE XEROGRAPHIC CUT SHEET PRINT ENGINE

[75] Inventor: Denis J. Stemmle, Milford, Conn.

[73] Assignee: Xerox Corporation, Stamford, Conn.

[21] Appl. No.: 941,622

[22] Filed: Sep. 30, 1997

[51] Int. Cl.[6] ..... G03G 15/00

[52] U.S. Cl. ..... 399/384; 399/1; 399/110; 399/385; 399/391

[58] Field of Search ..... 399/384, 385, 399/386, 387, 110, 391, 107, 1, 2, 3

[56] References Cited

U.S. PATENT DOCUMENTS

| | | | |
|---|---|---|---|
| 3,548,783 | 12/1970 | Knapp | 118/224 |
| 3,940,210 | 2/1976 | Donohue | 355/14 |
| 4,134,341 | 1/1979 | Weigele et al. | 101/142 |
| 4,929,982 | 5/1990 | Ainoya et al. | 355/313 |
| 5,091,967 | 2/1992 | Isobe | 355/310 |
| 5,568,245 | 10/1996 | Ferber et al. | 355/309 |
| 5,629,775 | 5/1997 | Platteter et al. | 358/296 |
| 5,751,298 | 6/1998 | Crowley | 399/385 |

FOREIGN PATENT DOCUMENTS

| | | |
|---|---|---|
| WO9602872A1 | 2/1996 | WIPO . |
| WO 96/14605 | 5/1996 | WIPO . |

OTHER PUBLICATIONS

Xerox Disclosure Journal, vol. 9, No. 3, May/Jun., 1984, pp. 201–203 Method for duplex printing on continuous web paper, by: E. McIrvine.

*Primary Examiner*—R. L. Moses
*Assistant Examiner*—Shival Virmani

[57] ABSTRACT

A plural mode printing system utilizing a cut sheet print engine for printing conventional cut sheet print substrates, in which page print images are generated and transferred to the cut sheets at an image transfer station. This plural mode printing system selectively provides printing onto either the cut sheets or onto an uncut continuous web printing substrate, in the same cut sheet print engine. An independently moveable continuous web printing substrate supply module is selectively operatively docked with the cut sheet print engine. That web printing module has a web feeding and image transfer assistance system for feeding the continuous web uncut into the cut sheet printing engine for transferring the page print images onto the web instead of onto cut sheets when the print engine is operatively docked with the web printing substrate module. The web printing module does not itself need to print. Rather, it can feed an extended loop of the continuous web into the cut sheet print engine image transfer station. The web module may provide either simplex printing or duplex printing onto both sides of the web with a duplexing system for feeding the web into the print engine for image transfer twice, with web inversion in between. The web modules are also preferably interchangeable with an optional cut sheet supply module.

14 Claims, 4 Drawing Sheets

Figure 1:
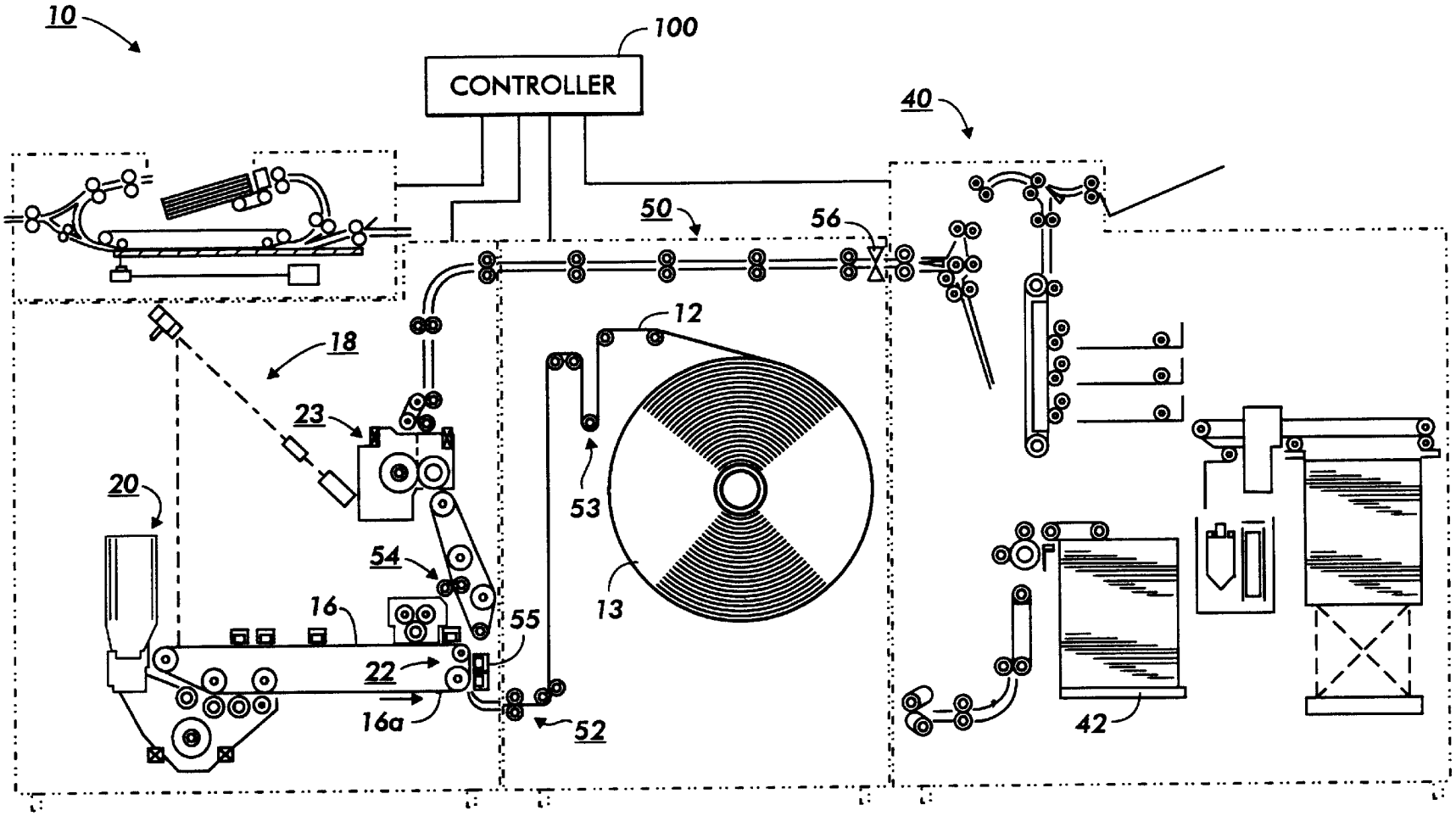

DUAL MODE INTERCHANGEABLE MODULES CUT SHEET OR WEB PRINTING SYSTEM WITH A SINGLE XEROGRAPHIC CUT SHEET PRINT ENGINE

Cross-reference is made to other contemporaneously filed and commonly assigned applications by the same inventor also relating to web printing systems; U.S. application Ser. Nos. 08/941,848; 08/941,133; 08/940,951; and 08/940,917.

The subject system relates to improvements in printing systems providing for selectably printing onto either a continuous web substrate or selected cut sheet substrates, with a single print engine, as opposed to printing systems requiring separate, dual, or multiple print engines.

More specifically, the embodiments herein disclose a dual mode interchangeable cut sheet or web printing system with a single common xerographic print engine which can selectively provide printing onto either cut sheet or continuous web substrates using the same print engine, to selectably provide their respective printing advantages as described herein. For example, (but not limited thereto) to select cut sheet printing for intermixed substrates print jobs and/or for duplex printing and to select continuous web printing for lower cost and more reliable long production runs. As shown and described herein, it has been found this can be accomplished by a modular exchange and/or transfer station interface with a web supply module. The interdocument pitch spacing can also be changed in coordination with this printing mode change. Also disclosed are interchangeable simplex and duplex web feeding and printing transfer modules which are both interchangeable with the same cut sheet print engine.

The plural mode system of the disclosed embodiments can incorporate and utilize existing or conventional cut sheet print engines, with very little if any structural modification thereof, by integration with a web feeding module, which can be moved to and from any desired location, instead of requiring expensive specially built web printing machines only capable of web printing. Here, the same cut sheet print engine can be used for, and easily changed between, cut sheet or continuous web substrate printing, for either simplex or duplex (both sides) printing.

By way of background, in reproduction apparatus such as xerographic and other copiers, printers or multifunction machines, it is increasingly important to provide faster yet more reliable and more automatic handling of the physical image bearing substrate. High speed printing of individualized document images by xerographic, ionographic, ink jet or other copiers, printers or other reproduction apparatus (encompassed by the word printers here) has become increasingly important and increasingly demanding in terms of quality, reliability, and other features. Enhanced printing features can include the ability to do either full color or black and white printing, and printing onto one or both sides of the image substrate, i.e., simplex or duplex printing.

As is well known in the art, duplex printing onto pre-cut paper sheet substrates, as in conventional xerographic copiers or printers, is much easier than duplex web printing. In cut-sheet printing machines duplexing is typically done by generating and transferring visible images to one side of the copy sheets, then inverting those copy sheets before or in a duplex loop path (which may be either an endless path, or include a duplex intermediate storage or buffer tray), and then returning those inverted sheets in the duplex loop path back to the same or another transfer station for transferring a second side image to the second side of the sheets before they exit the printing machine.

However, it is also well known that, especially for very high speed or high volume copying or printing, it is desirable to use a continuous web print substrate in some applications. In web feeding, instead of feeding pre-cut sheets to be printed, the image substrate material is typically fed from large, heavy rolls of paper, which can be from paper mill rolls, and thus provided at a lower cost per printed page than pre-cut sheets. (Fan-fold or computer form web substrate can also be used in some limited printing applications, e.g. where edge sprocket hole feeding is desired.) Typically, with web roll feeding, the web is fed off the roll and through the xerographic or other print engine to be printed and thereafter cut in a chopper and/or slitter at or after the printer output to form the desired copy sheets. Alternatively, the printed web output be rewound onto an output roll (uncut) for further processing off line. Web paper has feeding and printing reliability and plural image registration advantages as compared to conventional precut sheets. That is, in addition to the cost advantages, web feeding can also have advantages in feeding reliability, i.e., lower misfeed and jam rates within the printer as compared to high speed feeding of precut sheets through a printing apparatus. A further advantage is that web feeding from large rolls requires less downtime for paper loading. For example, it is not uncommon for a system printing onto web paper from a 5 foot diameter supply roll to print continuously for an entire shift without requiring any operator action, compared to the need for an operator to re-load cut sheet feeders 2 to 3 times per hour on a typical cut sheet feeder system of equivalent speed. Continuous web printing also provides greater productivity for the same printer processing speed and corresponding paper path velocity through the printer, since with web printing the images can be printed in direct sequence, with no pitch space skips between images as is required between each sheet for cut sheet printing. Continuous web xerographic copying was pioneered by Xerox (then Haloid) Corp. with the 1955 introduced "Copyflo"® printer.

However, continuous web feeding and printing typically requires a larger printing engine, taking more floor space, and special transport and loading assistance for the heavy paper rolls. Also, the web has to be threaded into the machine from the roll, and/or may need to be spliced onto the end of the prior exhausted paper roll.

Web feeding is more suitable where the same substrate can be used for all or most of long runs of single sheet documents, or-multi-page multiple print jobs in a printing run, all to be printed on the same substrate media. Quickly or easily changing between substrates is much more difficult with a web fed machine than a cut sheet machine. In a cut sheet machine different sheets of different sizes, weights, colors, pre-prints, holes, etc. can be loaded into different paper feeding drawers, and easily changed or substituted. The printer can automatically feed from any selected paper feed drawer or tray at any time to print intermixed sheet print jobs. In contrast, roll fed web machines typically require stoppage and re-threading of the web through the machine to change the web substrate, and some wastage in doing so.

However, in either web fed or cut sheet machines is also possible to use interposers or inserters downstream of the printing apparatus to insert preprinted sheets of different substrates, characteristics or dimensions into the printing job stream for intermixed substrate jobs. Examples of U.S. patents showing exemplary interposer modules are in, and cited in, U.S. Pat. No. 5,489,969. Such interposer modules can also include auxiliary external paper feed trays for feeding cut sheet image substrates back upstream into the print engine.

It is well known in general that interposers, sheet feeders, finishers, print engines and other components of printing systems can be add-on, interchangeable, or substitutable modules. Such modular sub-systems or components can be self-standing and mobile on wheels or tracks. Some examples of docking systems for print engines operatively connecting with independent sheet handling modules are disclosed in Xerox Corp. U.S. Pat. Nos. 5,553,843 and 5,326,093.

It is also know that the printer controller may desirably be automatically partially reprogrammed for different printing sequencing in general by or in accordance with the particular module attached to the printer, as disclosed in allowed Xerox Corp. U.S. Pat. No. 5,629,775 by Dale Platterter, et al., filed Jul. 27, 1994 as app. Ser. No. 08/289,978 (D/93465); and pending Xerox Corp. U.S. app. Ser. No. 08/846,191 (D/97166) filed Apr. 28, 1997, by David K. Young. Magnetic or other sources of a module docking signal are also taught in Xerox Corp. U.S. Pat. No. 5,138,373 issued Aug. 11, 1992.

It is also known to feed cut sheet substrates into a paper tray or other input of a regular cut sheet type printer or copier by automatically feeding and pre-cutting sheets from a paper roll feeding and cutting module operatively connected therewith. However, that does not provide the reliability and low jam rates of a printer in which high speed printing is done on an uncut or continuous web running through the printer and the sheets are chopped or cut into separate pages later, at the output of or after the printing operations. Also, such roll-cut sheets may have curl problems affecting their reliability in a conventional cut-sheet printer designed for reams of flat paper stock.

Roll feeding and printing systems can also be utilized for "two up" or "four up" (duplex signature) printing, by using wide web input of a dual page width and printing dual page images in side by side pairs on one or both sides, if the expense and space of a printing engine of that printing width can be justified.

However, another significant problem with web printing is that to do duplex (two-sided) printing on continuous web substrates is a much more difficult problem than for cut sheet printing machines. One solution has been to provide plural opposing print engines for respectively printing the opposing sides of the continuous web, as disclosed for example in Xerox Corp. U.S. Pat. No. 3,940,210 issued Feb. 24, 1976 to James M. Donohue (with a programmable electronic controller), allowed U.S. application Ser. No. 08/624,280 filed Mar. 29, 1996, by Paul F. Morgan, now U.S. Pat. No. 5,701,565 or U.S. Pat. No. 5,455,668 by Jan J. I. De Bock, et al. Another example of dual xerographic color engines for duplex printing on web material is shown in EP 0 742 497 A1 published Nov. 13, 1996 to Jan Van den Bogaert (Agfa-Gevaert). However, these plural print engine web printing duplex systems require a correspondingly plural increase in size, cost, complexity and maintenance. It may be readily seen from these and other art examples that using two entire color printing engines to print both sides of a continuous web requires a large amount of floor space and the coordination of at least two separate complex and expensive printing systems rather than one.

As noted, adding full color capability adds considerably to the disadvantages of a dual or plural engine duplex web printing system, and makes a single printing engine duplex system (more like that for duplex cut sheet machines) even more desirable.

Thus, while duplex printing is known for roll or fanfold web printing, it is much more difficult, expensive, and space-consuming, especially for color printing, than duplex printing of precut sheets. However, customer requirements such as for booklet or signatures (4 up) printing, and/or for economic and environmental savings of paper and postage, require duplex rather than simplex printing.

Some examples of modern full color cut sheet xerographic printing systems, with a photoreceptor belt and plural image development stations, which may be referred to for further details in connection with the enclosed embodiments, include Xerox Corporation U.S. Pat. No. 5,537,190 issued Jul. 16, 1996 to Folkins, et al; U.S. Pat. No. 5,508,789 issued Apr. 16, 1996 to Castelli, et al; U.S. Pat. No. 5,160,946 issued Nov. 3, 1992 to Hwang; and other references cited therein. Since the systems disclosed herein are not limited to any particular color printing engine or system, as long as it is compatible with the other features claimed, it will be appreciated that there is no need to describe these or other known or conventional xerographic color printing engines in any detail in this application.

It will be appreciated that known intermediate web transfer systems can be employed in xerographic or other printing, in which the images are formed on one or several (for color) photoreceptors and then initially transferred to an intermediate belt before a second and final transfer from that intermediate belt to the paper web 12. Some examples are in Xerox Corp. U.S. Pat. No. 5,508,789 and 5,631,686 and other art cited therein. The term image transfer station in the claims here may thus encompass such a transfer from an intermediate belt rather than directly from a photoreceptor unless otherwise so limited.

Art of particular interest here, in illustrating the possibility and difficulty of providing the capability for both simplex and duplex printing with a single xerographic print engine for a continuous web (here fan-fold) paper substrate, with inversion of the moving web for the second side printing, is U.S. Pat. No. 5,568,245 issued Oct. 22, 1996 to Otto Ferber, et al (Siemens Nixdorf) based on EPO App. No. 94112973, with other apparently related if slightly different published equivalent disclosures in German, including EP 771437-A1 (WO 9602872-A1—PCT/DC 95/00635) (note especially FIG. 1), and EP 699315-A1 (WO 9427193-A1).

Although said U.S. Pat. No. 5,568,245 shows and describes a drum photoreceptor, it also mentions in Col. 5, last paragraph, that "a web-shaped intermediate carrier, for example, an OPC band, can also be employed".

In said U.S. Pat. No. 5,568,245, the web turnover means of FIG. 3 and Cols. 8–10 in particular is of particular interest. It includes, as described therein, two sequential low friction web deflectors, rods, or drums, at approximately 45° relative to the paper running direction. This turnover means turns the recording medium over by 180° and also displaces it laterally by the width of one recording medium. These web deflectors may be hollow rods with integral air and wear resistant polished glide surfaces for low friction with the web recording medium. Further described in said U.S. Pat. No. 5,568,245 is that this turnover means has a first reverser following the first oblique deflector in the conveying direction for returning the recording medium toward a second reverser approximately parallel to the first reverser for a second reversal of the recording medium before the web enters the second oblique deflector. (It is noted that it seems easier to understand this web inversion system 28 from the FIG. 1 paper path drawing of the equivalent WO 9602872 A1 (PCT/DE 95/00635) than said U.S. Pat. No. 5,568,245.) In either case, it may be seen that there is a very long paper path of the web between its first and second side printing in that prior art system, and that the second side is printed in a separate web path parallel to the first side printing web path. That system, however, requires a double width photoreceptor drum and xerographic system since the second side image transfer station is laterally spaced along the axis of the photoreceptor from the first transfer station for the first side image.

It will be noted that the use of a 45° web baffle or deflector around which a continuous web is wrapped to turn the web over is well-known per se. It is illustrated in Xerox Corporation U.S. Pat. No. 3,548,783 issued Dec. 22, 1970 to Lowell W. Knapp for inverting the web between two xerographic print engines to provide duplex printing on the web. Duplex web printing using a series of three such web deflectors in series, so that the web enters and leaves the inverter in the same movement direction, is shown and described in the Xerox Disclosure Journal publication Vol. 9, No. 3, May/June, 1984, pages 201–203.

An additional difficulty in printing from an endless belt type photoreceptor printing engine onto a continuous web substrate is the fact that belt type photoreceptors, as compared to solid drum type photoreceptors, typically have a belt seam where the two ends of the belt are fastened to one another to form a continuous loop. Typically it is either impossible or undesirable to form images overlying this belt seam. Thus, in cut sheet machines, either the printing is skipped in the belt seam area, or the image positions on the belt are skipped or re-arranged where possible (depending upon their size) so as not to image overlying the belt seam area. However, these approaches often result in an asynchronous or irregularly spaced image production. That can present a significant problem to the transfer of those images to a mating continuous web image substrate which, unlike a copy sheet, cannot easily be asynchronously or intermittently fed to the image transfer station at which the image is transferred from the photoreceptor belt to the web substrate. That is because the substrate web is a continuum, and also because it is difficult or impractical to rapidly start and stop paper webs in a printing system they are running through at high speeds because of the danger of web tearing, slippage, or misregistration, and/or the large moment and mass of the paper roll. Buffer loops and dancers rolls are known for web input speed variations buffering.

Specific features and advantages of the specific embodiments disclosed herein include, in a printing system with a cut sheet print engine for printing conventional cut sheet print substrates, in which cut sheet print engine page print images are generated and transferred to said cut sheet print substrates at an image transfer station, the improvement comprising; a dual mode printing system selectively providing printing onto said cut sheet print substrates and onto an uncut continuous web printing substrate, with the same said cut sheet print engine, including an independently moveable continuous web printing substrate supply module, a docking system for selectively operatively docking and undocking said web printing substrate supply module with said cut sheet print engine; said web printing substrate supply module having a web feeding and image transfer assistance system for feeding uncut continuous web printing substrate material into said cut sheet printing print engine for transferring said page print images onto said continuous web printing substrate fed from said web printing substrate supply module instead of said cut sheet print substrates when said cut sheet print print engine is operatively docked with said web printing substrate module.

Further specific features and advantages disclosed herein, individually or in combination, include those wherein said web printing substrate supply module web feeding and image transfer assistance system feeds an extended loop of said continuous web printing substrate into said cut sheet print engine when said cut sheet print engine is operatively docked with said web printing module; and/or wherein said web printing substrate supply module web feeding and image transfer assistance system feeds said continuous web printing substrate into said cut sheet print engine to said image transfer station when said cut sheet print engine is operatively docked with said web printing module; and/or wherein said web printing substrate supply module web feeding and image transfer assistance system includes a web inversion and duplexing system for feeding said continuous web printing substrate into said cut sheet print engine twice, with said web inversion therebetween, for transferring said page print images onto both sides of said continuous web printing substrate fed from said web printing substrate supply module when said cut sheet print engine is operatively docked with said web printing module; and/or further including a cut sheet supply module with plural sheet feeding trays for said cut sheet print substrates, said cut sheet supply module having a docking system for selectively operatively docking and undocking said cut sheet supply module with said cut sheet print engine in place of said web printing substrate supply module for feeding said cut sheet print substrates to said cut sheet print engine; and/or wherein two separate image transfer stations are provided for the opposite sides of said continuous web; and/or wherein said cut sheet print engine is automatically modified when said web printing module is docked therewith to change the sequence in which said cut sheet print engine generates and transfers said page print images; and/or wherein said cut sheet print engine is automatically modified when said web printing supply module is docked therewith to increase the rate at which said cut sheet print engine generates and transfers said page print images by reducing spacing therebetween; and/or wherein said cut sheet print engine is automatically modified when said web printing module is docked therewith to change the sequence in which said cut sheet print engine generates and transfers said page print images for proper page order for said duplex image transfer onto said web; and/or wherein said cut sheet print engine is automatically modified when said web printing module is docked therewith to automatically disable printing said cut sheet print substrates; and/or wherein there are three different alternatively interchangeable modules selectably dockable with said cut sheet print engine: a said web printing substrate supply module providing simplex web printing with a single image transfer station, a said web printing substrate supply module providing duplex web printing with two image transfer stations, and a cut sheet printing substrate supply module utilizing said same single image transfer station; and/or wherein said web printing substrate supply module web feeding and image transfer assistance system includes a web inversion and duplexing system for feeding said continuous web printing substrate into said cut sheet print engine twice, in two different image transfer stations, with said web inversion therebetween, for transferring said page print images onto both sides of said continuous web printing substrate fed from said web printing substrate supply module, when said web printing substrate supply module is operatively docked with said cut sheet print engine; and/or wherein only one of said two transfer stations is engaged at a time; and/or wherein both of said two transfer stations are arrayed in line in the direction of movement of said photoreceptor so as not to require a photoreceptor substantially wider than said web.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs.

It is well known that the control of document and copy sheet handling systems may be accomplished by conventionally actuating them with signals from a microprocessor controller directly or indirectly in response to simple programmed commands, and/or from selected actuation or non-actuation of conventional switch inputs such as switches selecting the number of copies to be made in that job or run, selecting simplex or duplex copying, selecting a copy sheet supply tray, etc. The resultant controller signals may conventionally actuate various conventional electrical solenoid or cam-controlled sheet deflector fingers, motors or clutches, or other components, in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders and inverters, etc., as is well known in the art.

In the description herein the terms "web", and "sheet", respectively refer to a flimsy physical elongate web, or cut sheet, of paper, plastic, or other suitable physical substrate for printing images thereon. A "job" or "print job" is normally one or more sets of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Figure 2:
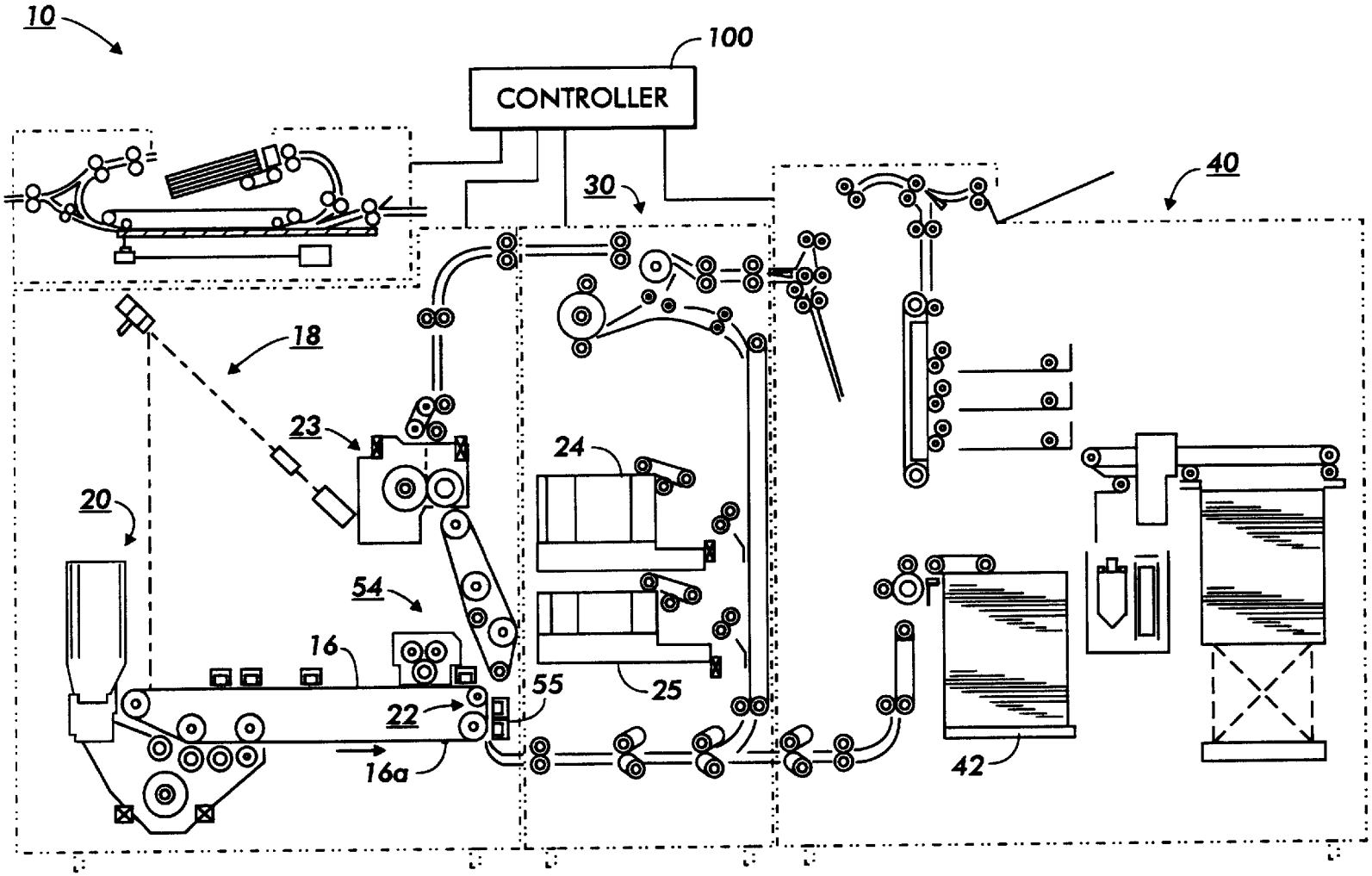
Figure 3:
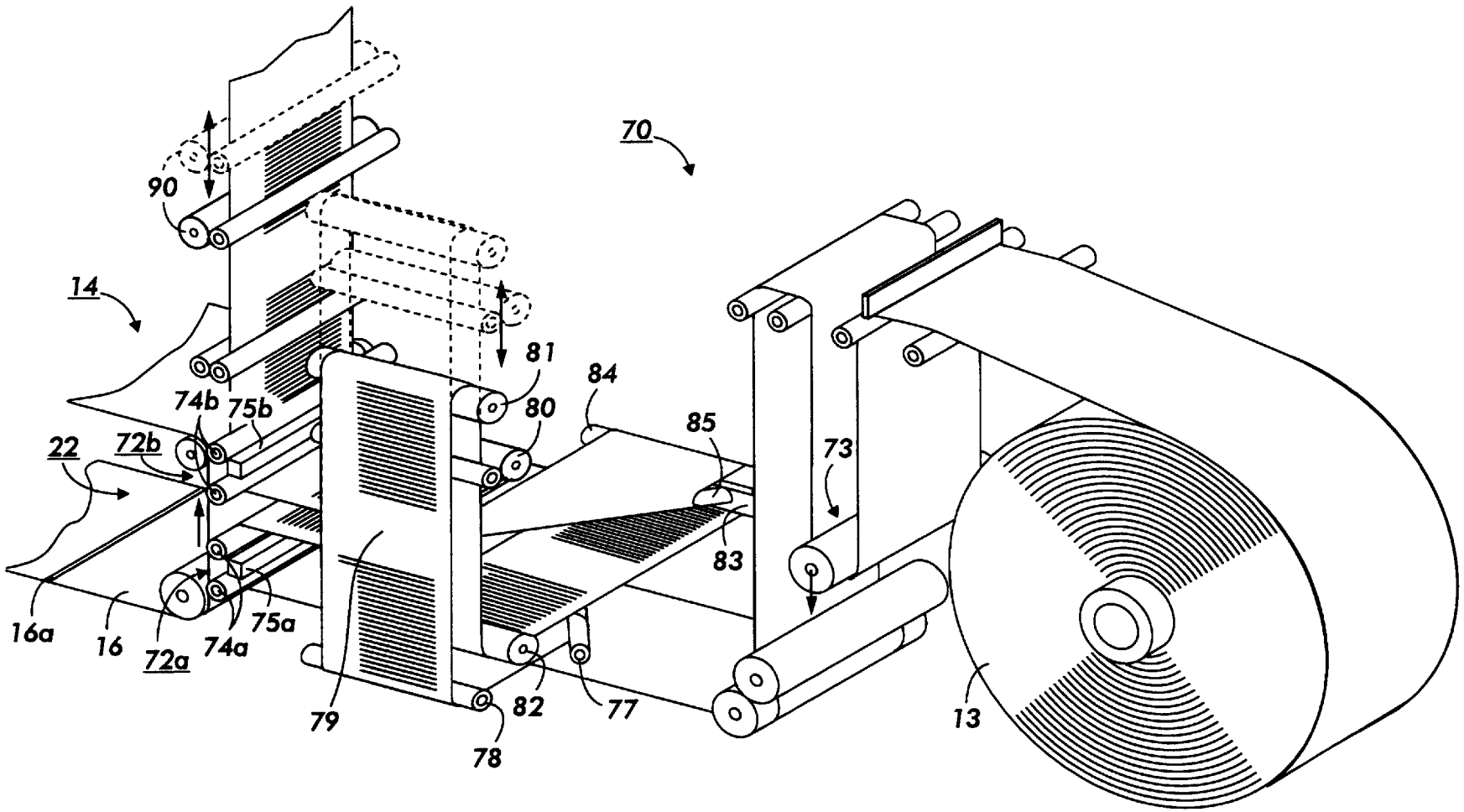
Figure 4:
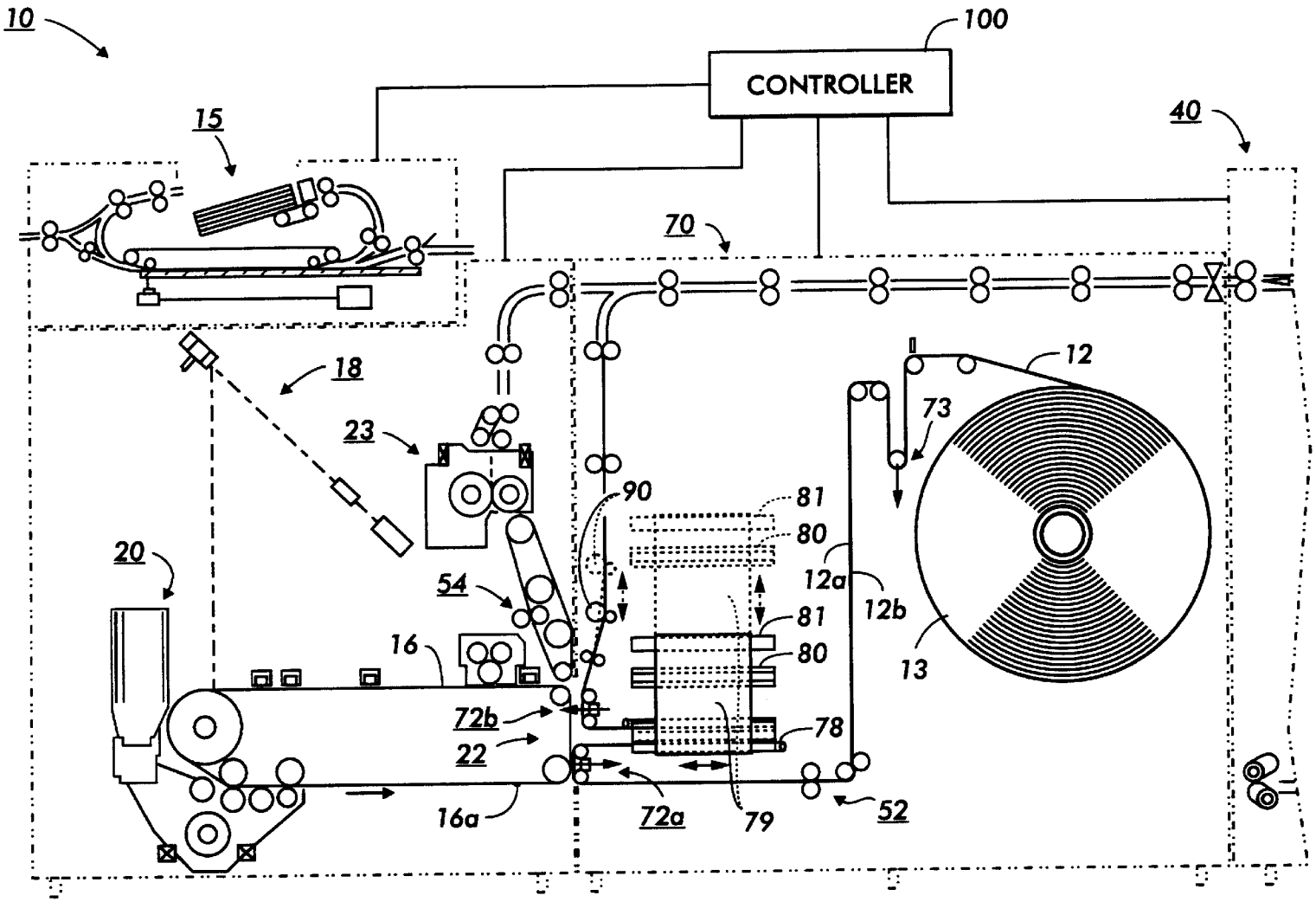

Various of the above-noted and further features and advantages will be apparent from the specific apparatus and its operation described in the examples below, including the drawing figures (approximately to scale) wherein:

FIG. 1 is a schematic frontal view of one example of the subject dual mode (cut sheet or continuous web) printing system with a single engine xerographic printer, here an otherwise unmodified conventional cut sheet printer, combined or docked with a continuous web module for simplex printing onto a continuous web substrate fed therefrom to the transfer station of the printer, as will be described, and an integrated exemplary finisher module;

FIG. 2 is similar to FIG. 1 but showing the interchange of a cut sheet feeder and/or interposer module replacing the FIG. 1 exemplary continuous web module;

FIG. 3 is an enlarged frontal perspective schematic view of the paper path of an alternative, duplex, embodiment or version of said continuous web module plus the mating portion of said single xerographic printing engine as modified by having two sequential transfer stations for image transfers to both sides of the web fed from said alternative web module; and FIG. 4 shows a schematic frontal view of the duplex web printing module of FIG. 3 operatively docked with the same ct sheet print engine and finisher module as shown in FIGS. 1 and 2.

Shown in the Figures by way of one example is one embodiment of a plural mode printing system 10 for printing desired page images on a continuous web substrate 12, or, alternatively, on cut sheet substrates, with the same print engine 14. FIG. 1 shows a web printing mode of operation with a simplex-only continuous web printing substrate supply module. FIG. 2 shows a cut sheet printing mode of operation with a conventional cut sheet supply module. That is, by being a modular system, web printing may be easily replaced by conventional printing onto conventional cut sheet substrates as in FIG. 2. The embodiment of FIGS. 3 and 4 shows one example of another substitutable module for another mode of operation in which the continuous web substrate 12 may be duplex printed on both of its sides 12*a* and 12*b*. The roll 13 from which the web 12 is being fed to be printed in the printing system 10, and various other conventional or known components, may be common to different modes and modules, and need not be fully illustrated or discussed here.

The printing system 10 here shows a single exemplary well known conventional xerographic printing engine 14 which is normally only capable of cut sheet printing. Various such printers can be used in the subject overall printing system 10. The illustrated printer or copier 14 is essentially the Xerox Corporation "DocuTech"® printer. As shown schematically with dashed line outlines in both FIGS. 1 and 2, the printer 14 may, only if additionally desired, optionally include, on or connecting therewith, a known document sheet feeding and digital scanning module 15 and/or an integral or separate electronics input and/or network server module, as on the left side of printer 14 here. That type of cut sheet printer example 14 is shown and described in numerous Xerox Corporation patents, such as U.S. Pat. Nos. 5,095,342 and 5,489,969, and thus need not be described in detail herein. In this exemplary printer or print engine 14 a conventional single endless belt photoreceptor 16 is being conventionally sequentially latent imaged with page images, such as by a ROS laser printing imaging system 18, or an LED bar, or the like. The latent images are developed with visible image developer material by a development system 20, which may include plural development units for plural colors. At an image transfer station 22 the developed images are transferred from the photoreceptor 16 to one side of the image substrate. In this particular printer embodiment the transfer station is located near the downstream side of the printer 14, where the photoreceptor belt 16 is moving vertically upward. Within the xerographic print engine 14 a conventional fusing system 23 is provided in which the transferred developed images are fused to the cut sheets image substrates when the system 10 is in a cut sheet printing mode. Conventionally, as in the mode of FIG. 2, that image substrate is a cut sheet fed to the transfer station 22 from a selected internal cut sheet feed tray of the printer 14, or, as shown, from cut sheet feed trays such as such as 24 or 25 in an integral cut sheet module 30 as shown in FIG. 2. Optionally, another source of cut sheet for printer 14 substrate input can be a high capacity sheet feeder 42 in a conventional finisher and output sets stacker module 40. Other external auxiliary cut sheet feed trays, such as sheet feed trays in an interposer or other module may be used (note the descriptions thereof cited above). Note that the interchangeable cut sheet module 30 of FIG. 2 is optional, and is not essential to the system 10. As shown in FIG. 2, the printer 14, the cut sheet module 30 and the finisher module 40 may be conventionally interconnected or docked together in series in that order to form an interconnected cut sheet supply, printing and on-line processing paper path system. Similarly, as shown in FIGS. 1, 3 and 4, it is the printer 14, the (interchanged) web feed module 50 or 70, and the finisher module 40 that form may form an integral paper path system.

The printer 14 may be conventional controlled by a conventional programmable controller 100, as described above. As per the above-cited art, the controller 100 here may desirably be automatically partially reprogrammed by or in accordance with the particular module attached to the printer 14. In particular here, reprogramming the page image spacing and/or sequence on the photoreceptor between that appropriate for image transfers to cut sheet or a continuous web.

In this system 10, the advantages of cut sheet printing may be retained, and additionally, alternatively, as in FIGS. 1, 3 or 4, the images to be printed may instead be sequentially transferred to areas of the selected continuous web 12 by the same print engine 14 in a web printing mode. As shown, that may be accomplished here by a connecting but removable continuous web module 50 of FIG. 1, or 70 of FIGS. 3 and 4, for printing with this same print engine 14 onto portions of the continuous web substrate 12 fed from the module 50 or 70 to the transfer station 22 of the printer and then removed from the transfer station 22 for downstream fusing and cutting into page image sheets. In the web printing mode of the system 10 here, the web modules 50 and 70 here may have their own internal imaged web fusing systems. The module 70 here is an alternative, duplex, version of the continuous web module 50. Either or both, and other, modules can be optionally available to customers, if desired, although of course only one at a time would be operationally docked with the printer 14. The module interchange can be simply accomplished with simple conventional docking latches and wiring harness interconnect plugs as these independently wheeled units are wheeled together with the print engine 14.

However, for simplex web printing, as done in the FIG. 1 embodiment, the web may be fed from the transfer station 22 after transfer up through the exisiting printer 14 fusing system 23 and then out of the printer 14 normal sheet output path, assuming that output path portion of the printer 14 paper path can be modified to handle uncut web feeding therethrough (including selectable modification of the sheet jam detector software for web feeding in that path portion).

It is important to see that the only mechanical or shared paper path portion or connection needed of the printer 14 for either the module 50 or 70 is the small area of its transfer station 22. Since that is at one side of this printer 14 it is easily accessible by a docking aperture shown in that side wall of the printer 14 into which the transfer station 52 of the module 50 projects when it is docked there, or, into which the two adjacent transfer stations 72*a* and 72*b* of the module 70 project when that duplex module 70 is docked with the print engine instead. The present system is, however, not limited to printers with that particular side transfer station 22 location, although then the modules 50 or 70 would have to have a correspondingly different docking configuration. Various known docking systems can be used for selectively operatively docking and undocking said web printing supply module with said sheet print engine. As noted above, some further examples of module docking systems for print engines and operatively connecting independent sheet handling modules are disclosed in Xerox Corp. U.S. Pat. Nos. 5,553,843 and 5,326,093.

It is important to note that the web printing modules 50 or 70 here do not themselves generate or print the page print images. Rather, they include a system to feed an extended loop of the continuous web into the cut sheet print engine to the image transfer station area and the printing is done by the same existing cut sheet print engine.

In both the modules 50 and 70, the web 12 conventionally is fed off of the roll 13 into a conventional dancer roll buffer loop system 53, 73, respectively, for movement variations compensation. A movable paired transfer rolls system 54 or 74*a*, 74*b* is provided to move one side of the web 12 into the printer 14 against the photoreceptor 16 in the transfer station 22 whenever it is desired, or the appropriate time, to transfer a developed image to the web 12. The web 12 is transported by its web drive system (a downstream driven rollers web pulling nip) at substantially the same velocity as the surface of the photoreceptor 16, which moves normally. As is well known, in the image transfer area, the web may be driven at the same speed as the photoreceptor by the electrostatic tacking of the paper to the photoreceptor. That can be assisted by slack or dancer loops in the web provided in the web transport or feeding path before and after transfer. Or, a constant slip system can be used in which the web is driven at approximately 0.25% or less faster or slower than the photoreceptor surface. A part of the web drive may be provided by the driving of the nips of the illustrated roll fusers. However, additional conventional driven feed roller nips can be provided, not all of which need be illustrated here, for drawing clarity.

A conventional coratron or scoratron such as 55 or 75*a*, 75*b* may be mounted in the module 50 or 70 behind the web 12 intermediate the web transfer rolls system 54, 74 at the transfer station 22 may be used for conventional transfer. Alternatively the existing transfer coratron or scoratron of the printer 14 can be used. That existing corona transfer device can be automatically removed by the web module insertion, slid out forward for the module docking, then slid back into position behind the web after docking. Alternatively, the module 50 or 70 can provide a known biased transfer roll system for the web for the web transfer roll system.

By changing the imaging system 18 input, buffering and/or internal software to eliminate the normal interdocument or pitch gap required for cut sheet printing, as is known for web printing, continuous printing onto the web 12 can be provided from the same machine 14. This allows a higher printing rate (more pages per minute) than for cut sheets with no increase in process speed (photoreceptor velocity, etc.). That also means that the web transfer rolls system 54, 74 does not need to retract to remove the web from the photoreceptor between each page image. Preferably, this software change occurs automatically upon and from the electrical interconnection of the module, or a docking switch signal, identifying to the controller that a modular unit is connected for web printing versus cut sheet printing.

However, if, as is usually the case, the photoreceptor 16 is a seamed web belt, with a belt ends fastening seam such as 16*a*, it may be desirable for the web transfer rolls system 54, 74 to briefly lift the web 12 away from the photoreceptor 16 for the passage of the unimaged area around that belt seam to avoid a wasted unprinted or blank space on the web every time that portion of the photoreceptor belt comes around (every few pitches). The web transfer rolls system 54, 74 thus provides an integral web loop which may also be coordinated with a temporary interruption in the downstream web feeding, so that, as that web loop is retracted and then expanded (as the web is removed from and then returned to engagement with the photoreceptor), the web 12 does not advance between its removal and return in that area, so that no unprinted area wastage need occur. The web may also be effectively slightly rewound back to the end of the prior transferred image area in the web transfer loop. The next image can thus be printed onto the web 12 directly following the previous image thereon even though the photoreceptor 16 has a substantial gap between its images for the unimaged photoreceptor belt splice or seam area.

In both the modules 50 and 70 there may be provided, in the web exit paths therefrom, respective conventional web choppers 56, 76 coordinated with the known transferred image positions on the web to cut the web printed output into separate imaged cut sheets before the output, as is well known per se. Here, the modules 50 and 70 are preferably docked, at their sides opposite from their printer 14 docking side, with the existing or conventional on-line finisher module 40 normally docked directly with the printer 14 to receive its printed cut sheet output. Also, the modules 50 and 70 here have their output at the same height at the cut sheet output of the printer 14. Thus, here the output of the web printing module 50 or 70 can be fed directly into the finisher 40, as shown, to be stacked, stapled, glued, bound or otherwise finished in job sets or books in the same manner, and using the same existing output/finishing hardware.

Turning now the further details of the duplex web printing module 70 of FIG. 3, it may be seen that in this module 70 a web paper path system is provided for turning over (inverting) the web 12 after one side 12*a* has been imaged at the first side transfer station 72*a,* and fused in a first roll fuser 80, then returning the inverted web 12 in proper page sequence for its opposite, second, side 12*b* printing at a second, adjacent, transfer station 72*b*. Both transfer stations 72*a* and 72*b* (like the transfer station 52 of the other module 50) fit into the approximate space and photoreceptor engagement area normally occupied by the cut sheet printing transfer station 22. Furthermore, a wider, dual image width, photoreceptor is not required here either. The two transfer stations 72*a* and 72*b* here for printing the two sides of the web 12 here and the images to be transferred are sequentially aligned in the direction of movement of the photoreceptor 16, not side-by-side transversely of the photoreceptor as in the above-cited U.S. Pat. No. 5,568,245.

The turnover and image position synchronization system or web 12 path illustrated in FIG. 3 includes, in sequence, following the return of the web back from the first imaging station 72*a,* a first forty-five degree or right angled web turnover bar 77 (see art cited above), a first ninety degree web turn roller 78 to turn the web vertically into a first or side one web expandable loop 79 formed by an outer, first, 180 degree web turn roller 81, then a first side moving roll fuser 80 (see their alternate position in phantom showing the loop 79 expansion); a second ninety degree web turn roller 82; an inner, second, 180 degree and elevation change pair of rollers 83, 84; and a second forty-five degree web turnover bar 85 directing the inverted web back for its second side 12*b* image transfer station 72*b,* from which the web moves up into a second side roll fuser 90.

As shown, the web may be pushed into and held in the first transfer station 72*a* against the photoreceptor for first side image transfer by a commonly movable pair of rollers 74*a* on each side of the transfer corona source 75*a* for that transfer. Likewise, after its above-described web inversion path, or other inversion system, such as a moebius strip inversion path, the web may be pushed into the adjacent second transfer station 72*b,* just downsteam of 72*a,* for a second side image transfer by the movable pair of rollers 74*b* on each side of that transfer corona source 75*b*. In both, a web loop is formed for these transfer stations extending into and out of the print engine 14, and in and out of the duplex web printing substrate supply module 70.

In this disclosed single engine but duplex web printing system, since only one side image is transferred at a time, while the side one image is being transferred to side one of the paper web at the first transfer station 72*a,* the portion of the web at the second transfer station 72*b* is held stationary, and is not in contact with the photoreceptor. A variable size web buffer loop 79 formed by translatable roller 81 is provided as shown in the web (paper) path between the two transfer stations 72*a,* 72*b* to temporarily store a web segment with plural side one images. When a batch of such side one images is complete, the web motion at the first transfer station 72*a* stops while that transfer station 72*a* is lifted out of contact with the photoreceptor 16. The second transfer station 72*b* is then moved into contact with the photoreceptor to transfer a corresponding number of side two images onto the back of the side one images previously transferred. At this time, the portion of the web at the first transfer station 72*a* is held stationary, and paper is supplied to the second transfer station by advancing the completed side one images previously stored in the web buffer loop 79.

The printer 14 imaging input system and controller 100 previously have electronically separated the incoming print job electronic pages into batches of plural first and second (even and odd, or vice versa) pages to be imaged in that batch order on the photoreceptor in batches to match the above-described web buffer loop 79 plural images capacity. (As to batch mode duplex electronic printing in general, see Xerox Corp. U.S. Pat. No. 4,918,490 issued Apr. 17, 1980 by this same inventor.)

An additional web buffer loop 73 is provided prior to the first transfer station here. Thus, when the web is being imaged at the second transfer station, and the portion of the web at the first transfer station is temporarily stopped, the massive paper supply roll 13 need not be stopped. The supply roll 13 may continue to unwind and supply paper, which is temporarily stored in this pre-side one buffer loop, to be depleted when the system begins to transfer side one pages again (the next batch of side one pages). With this arrangement, even when the system is running duplex images, the supply roll 13 can operate at a relatively steady speed which is half the speed required for simplex images. The main benefit of this additional (pre-side one) buffer loop, is substantially less power and precision required to drive the supply roll 13.

Although the fuser rolls may be conventionally stationary, i.e., remaining in the same position, as an additional, optional, disclosed feature, the first and second side roll fusers 80 and 90 are also shown here in phantom alternate positions to illustrate that they may move up and down, if desired. That is, the fuser 80 can fuse continuously at half the web process speed, moving up and down as its web expansion loop 79 expands and contracts. The fuser 90 likewise may travel up with the web 12 to fuse at half speed when the web 12 is moving at its full speed and move down when the web 12 is stopped, even though there is no pitch space between images in efficient web printing. There is translation of the fuser roll nip in both directions along the web, from and back to an original position. With the illustrated web duplexing system, half of the time, the portion or segment of the web in the fuser nip is stopped. It is while that segment of the web is stopped that the fuser roll translates back to its initial position at half speed, with the rolls still engaged, continuing to fuse the web all the way. That is, the fuser rolls never separate and continuously fuse images to the paper regardless of whether the paper is moving or stopped, and regardless of the direction the fuser translates. While the web is in motion, the fuser translates in the direction of the web movement at half the speed of the web. The fuser rolls of course always rotate in a reverse rotation to the direction of web movement When the web stops, the translation direction of the fuser rolls changes, but the direction of rotation of the rolls does not change. I.e., the direction of rotation of the fuser rolls never changes and the rolls never separate. Only the direction of their translation changes. The time required to image one side of the web (i.e., the time the fuser rolls translate in the direction of web motion and the time that segment of web is in motion) equals the time required to image the other or second side of the web, which equals the time the fuser rolls translate backwards as well as the time the segment of the web remains stationary. Thus, the fuser rolls return to the start position, and the entire segment of the web is fused at the same relative speed, which is half the imaging speed. Neither fuser requires a variable rather than a fixed speed drive. Since these fusers can fuse at half the process speed in duplex printing, they can be less power-demanding.

It will be appreciated that the duplex web embodiments can alternatively also do simplex printing, i.e., printing only one side of the web. This may be done in the duplex embodiments by only engaging and using one transfer station and one fuser, continuously.

If there is a seam in the photoreceptor, seam skipping to avoid paper waste can be provided by briefly removing the web from the photoreceptor in the transfer station, backing up (reversing) the web there by the unimaged area distance that was skipped for the seam, and then re-engaging the web with the photoreceptor with the web positioned so that the next image prints directly after the prior image. This may be done each time the unimaged photoreceptor seam area passes under the transfer station, so that the printed web has continuous images with no blank paper sections between images that would need to be cut off and discarded.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a printing system with a cut sheet print engine for printing conventional cut sheet print substrates, in which cut sheet print engine page print images are generated and transferred to said cut sheet print substrates at an image transfer station, the improvement comprising;

a dual mode printing system selectively providing printing onto said cut sheet print substrates and onto an uncut continuous web printing substrate, with the same said cut sheet print engine, including;

an independently moveable continuous web printing substrate supply module, a docking system for selectively operatively docking and undocking said web printing substrate supply module with said cut sheet print engine;

said web printing substrate supply module having a web feeding and image transfer assistance system for feeding uncut continuous web printing substrate material into said cut sheet printing print engine for transferring said page print images onto said continuous web printing substrate fed from said web printing substrate supply module instead of said cut sheet print substrates when said cut sheet print print engine is operatively docked with said web printing substrate supply module.

2. The printing system of claim 1, wherein said web printing substrate supply module web feeding and image transfer assistance system feeds an extended loop of said continuous web printing substrate into said cut sheet print engine when said cut sheet print engine is operatively docked with said web printing substrate supply module.

3. The printing system of claim 1, wherein said web printing substrate supply module web feeding and image transfer assistance system feeds said continuous web printing substrate into said cut sheet print engine to said image transfer station when said cut sheet print engine is operatively docked with said web printing substrate supply module.

4. The printing system of claim 1, wherein said web printing substrate supply module web feeding and image transfer assistance system includes a web inversion and duplexing system for feeding said continuous web printing substrate into said cut sheet print engine twice, with said web inversion therebetween, for transferring said page print images onto both sides of said continuous web printing substrate fed from said web printing substrate supply module, when said web printing substrate supply module is operatively docked with said cut sheet print engine.

5. The printing system of claim 1, further including a cut sheet substrate supply module with plural sheet feeding trays for said cut sheet print substrates, said cut sheet supply module having a docking system for selectively operatively docking and undocking said cut sheet supply module with said cut sheet print engine in place of said web printing substrate supply module for feeding said cut sheet print substrates to said cut sheet print engine.

6. The printing system of claim 4, wherein two separate image transfer stations are provided for the opposite sides of said continuous web.

7. The printing system of claim 1, wherein said cut sheet print engine is automatically modified when said web printing substrate supply module is docked therewith to change the sequence in which said cut sheet print engine generates and transfers said page print images.

8. The printing system of claim 1, wherein said cut sheet print engine is automatically modified when said web printing substrate supply module is docked therewith to increase the rate at which said cut sheet print engine generates and transfers said page print images by reducing spacing therebetween.

9. The printing system of claim 4, wherein said cut sheet print engine is automatically modified when said web printing substrate supply module is docked therewith to change the sequence in which said cut sheet print engine generates and transfers said page print images for proper page order for said duplex image transfer onto said web.

10. The printing system of claim 1, wherein said cut sheet print engine is automatically modified when said web printing substrate supply module is docked therewith to automatically disable printing said cut sheet print substrates.

11. The printing system of claim 1, wherein there are three different alternatively interchangeable modules selectably dockable with said cut sheet print engine: a said web printing substrate supply module providing simplex web printing with a single image transfer station, a said web printing substrate supply module providing duplex web printing with two image transfer stations, and a cut sheet printing substrate supply module utilizing said same single image transfer station.

12. The printing system of claim 1, wherein said web printing substrate supply module web feeding and image transfer assistance system includes a web inversion and duplexing system for feeding said continuous web printing substrate into said cut sheet print engine twice, in two different image transfer stations, with said web inversion therebetween, for transferring said page print images onto both sides of said continuous web printing substrate fed from said web printing substrate supply module, when said web printing substrate supply module is operatively docked with said cut sheet print engine.

13. The printing system of claim 12, wherein only one of said two transfer stations is engaged at a time.

14. The printing system of claim 12, wherein both of said two transfer stations are arrayed in line in the direction of movement of said photoreceptor so as not to require a photoreceptor substantially wider than said web.

* * * * *